US011607859B2

(12) United States Patent
Schalk

(10) Patent No.: US 11,607,859 B2
(45) Date of Patent: Mar. 21, 2023

(54) APPARATUS FOR THE PROVISION OF PACKAGING MATERIAL

(71) Applicant: Sprick GmbH Bielefelder Papier-und Wellpappenwerke & Co., Bielefeld (DE)

(72) Inventor: Bastian Schalk, Detmold (DE)

(73) Assignee: Sprick GmbH Bielefelder Papier- und Wellpappenwerke & Co., Bielefeld (DE)

( * ) Notice: Subject to any disclaimer, the term of this patent is extended or adjusted under 35 U.S.C. 154(b) by 126 days.

(21) Appl. No.: 16/678,832

(22) Filed: Nov. 8, 2019

(65) Prior Publication Data

US 2020/0070459 A1 Mar. 5, 2020

Related U.S. Application Data

(63) Continuation of application No. PCT/EP2018/061865, filed on May 8, 2018.

(30) Foreign Application Priority Data

May 8, 2017 (DE) ..... 102017109829.1

(51) Int. Cl.
*B31D 5/00* (2017.01)

(52) U.S. Cl.
CPC .... *B31D 5/0052* (2013.01); *B31D 2205/0035* (2013.01); *B31D 2205/0082* (2013.01);
(Continued)

(58) Field of Classification Search
CPC .. B31D 5/0052; B31D 5/0039; B31D 5/0047; B31D 5/0043; B31D 2205/0082;
(Continued)

(56) References Cited

U.S. PATENT DOCUMENTS 6,102,645 A * 8/2000 Kooima ..... B62B 5/0083 414/537
6,190,299 B1 2/2001 Simmons
(Continued)

FOREIGN PATENT DOCUMENTS

DE 195 36 367 A1 4/1997
DE 694 00 576 T2 4/1997
(Continued)

OTHER PUBLICATIONS

International Search Report and Written Opinion of the International Search Authority dated Aug. 22, 2018 in International Application No. PCT/EP2018/061884 (English and German languages) (14 pp.).

(Continued)

*Primary Examiner* — Thomas M Wittenschlaeger
(74) *Attorney, Agent, or Firm* — Banner & Witcoff Ltd.

(57) ABSTRACT

An apparatus for the provision of packaging material includes a forming unit for producing a cushion or tubular-like packaging material from a paper strip and for ejecting the packaging material. A feeding unit draws in the paper strip from a Leporello stack-shaped paper strip supply having two feed rollers opposing each other for driving the paper strip and a motor for operating the feed rollers. A preforming station is positioned upstream the feed unit in paper feed direction for transverse compression of the paper strip. A guiding unit is positioned upstream the preforming station in paper feed direction for aligning the paper strip for the preforming station and a frame, on which the preforming station is pivotably supported between a working position and a loading position.

14 Claims, 13 Drawing Sheets

(52) U.S. Cl.
CPC ..... *B31D 2205/0088* (2013.01); *B31D 2205/0094* (2013.01)

(58) Field of Classification Search
CPC .... B31D 2205/0094; B31D 2205/0088; B31D 2205/0035; B31D 2205/0005; B31D 2205/0047; B31D 2205/0076
See application file for complete search history.

(56) References Cited

U.S. PATENT DOCUMENTS

| | | | | |
|---|---|---|---|---|
| 6,632,165 | B1 | 10/2003 | Letourneau et al. | |
| 6,918,489 | B2 * | 7/2005 | Harding | B31D 5/0047 206/451 |
| 7,022,060 | B2 * | 4/2006 | Toth | B31D 5/0047 493/464 |
| 7,186,208 | B2 * | 3/2007 | Demers | B26F 3/02 493/350 |
| 8,303,475 | B2 * | 11/2012 | Wetsch | B31D 5/006 493/464 |
| 8,388,508 | B2 * | 3/2013 | Wetsch | B31D 5/04 493/464 |
| 8,696,345 | B2 * | 4/2014 | Sprick-Schutte | B31D 5/0047 425/403.1 |
| 8,944,982 | B2 * | 2/2015 | van der Kaap | B31D 5/0047 493/477 |
| 9,533,465 | B2 * | 1/2017 | Lintala | B31D 5/0047 |
| 2003/0080540 | A1 | 5/2003 | Kinane | |
| 2004/0266598 | A1 * | 12/2004 | Toth | B31D 5/0052 493/350 |
| 2005/0181924 | A1 * | 8/2005 | Demers | B31F 1/0003 493/350 |
| 2007/0287623 | A1 * | 12/2007 | Carlson | B31D 5/0047 493/464 |
| 2009/0004448 | A1 | 1/2009 | Tinianov | |
| 2012/0289392 | A1 * | 11/2012 | Cheich | B31D 5/0047 493/464 |

FOREIGN PATENT DOCUMENTS

| | | | |
|---|---|---|---|
| DE | 697 00 548 | T2 | 4/2000 |
| DE | 101 03 040 | A1 | 11/2001 |
| DE | 697 08 087 | T2 | 8/2002 |
| DE | 694 33 887 | T2 | 7/2005 |
| DE | 698 28 186 | T2 | 12/2005 |
| DE | 10 2012 018 867 | A1 | 3/2014 |
| DE | 10 2012 018 941 | A1 | 3/2014 |
| DE | 10 2012 218 679 | A1 | 4/2014 |
| DE | 10 2013 015 875 | A1 | 3/2015 |
| DE | 10 2014 016 874 | A1 | 5/2016 |
| DE | 10 2016 101 207 | A1 | 8/2016 |
| EP | 0 679 504 | A1 | 11/1995 |
| EP | 0 876 291 | | 11/1998 |
| EP | 1 497 049 | A2 | 1/2005 |
| EP | 1 964 804 | A2 | 9/2008 |
| EP | 2 171 167 | A1 | 4/2010 |
| EP | 2 711 168 | A1 | 3/2014 |
| EP | 2 719 526 | A1 | 4/2014 |
| FR | 2 970 921 | | 8/2012 |
| GB | 2 359 300 | A | 8/2001 |
| GB | 2501260 | A | 10/2013 |
| WO | WO 95/13914 | | 5/1995 |
| WO | WO 97/13097 | | 4/1997 |
| WO | WO 97/27136 | | 7/1997 |
| WO | WO 97/43097 | | 11/1997 |
| WO | WO 99/17923 | | 4/1999 |
| WO | WO 00/21723 | | 4/2000 |
| WO | WO 03/089163 | A2 | 10/2003 |
| WO | WO 2015/039756 | A1 | 3/2015 |
| WO | WO 2016/037764 | A1 | 3/2016 |
| WO | WO 2016/075001 | A1 | 5/2016 |
| WO | WO 2017/165321 | A1 | 9/2017 |
| WO | WO 2018/005902 | A1 | 1/2018 |

OTHER PUBLICATIONS

International Search Report and Written Opinion of the International Search Authority dated Jul. 20, 2018 in International Application No. PCT/EP2018/061848 (English and German languages) (10 pp.).
International Search Report and Written Opinion of the International Search Authority dated Jul. 20, 2018 in International Application No. PCT/EP2018/061860 (English and German languages) (10 pp.).
International Search Report and Written Opinion of the International Search Authority dated Jul. 20, 2018 in International Application No. PCT/EP2018/061685 (English and German languages) (10 pp.).
Office Action dated Feb. 8, 2018 for German Patent Application No. 10 2017 109 829.1, (10 pp.).
Office Action dated Dec. 12, 2017 for German Patent Application No. 10 2017 109 867.4, (10 pp.).
Office Action dated Dec. 5, 2017 for German Patent Application No. 10 2017 109 851.8, (10 pp.).
Office Action dated Nov. 28, 2017 for German Patent Application No. 10 2017 109 842.9, (10 pp.).

* cited by examiner

APPARATUS FOR THE PROVISION OF PACKAGING MATERIAL

PRIORITY

This application is a continuation application of International PCT Patent Application No. PCT/EP2018/061865 filed on May 8, 2018, entitled "APPARATUS FOR PROVIDING PACKAGING MATERIAL," which claims priority to German Patent Application No. 10 2017 109 829.1 filed on May 8, 2017, the entire contents of both of which are incorporated herein by reference.

TECHNICAL FIELD

The invention relates to an apparatus for the provision of packaging material used in logistics facilities, for example, for the mail order business, in order to fill the voids between articles to be shipped and the side wall of the shipping container with a cushion material. tube-like

BACKGROUND

Provision apparatuses for packaging material are known, for example, from U.S. Pat. No. 6,918,489 B2. The known provision apparatuses have a moveable frame with a forming unit put on top for the production of a cushion-like packaging material from the paper strip with an outlet opening for ejecting the packaging material. A paper supply, that for example can be realized as Leporello stack, can be provided underneath the forming unit of the known provision apparatus. During the operation of the apparatus, the paper strip is stripped from the Leporello stack and guided over several deflection rollers of a preforming station, which compresses the paper strip in transverse direction. The preforming station can be realized by a roll of bars being aligned behind each other with decreasing transverse distance to each other, guiding rollers opposing each other, a chute or such. Subsequently, the transversely compressed paper strip is fed to a pair of forming and/or feed rollers, which drive the paper strip and hence stripping it from the supply and acting deformingly on the paper strip, in order to form same into a tube-like, clustered or embossed packaging material. A cutting unit can be provided behind the rollers in paper feed direction, in order to cut off single packaging cushions from the tube-like packaging material. With this known provision apparatus, a separation of the paper strip in the preforming station or in the area of the feed or embossing rollers is often occurring, resulting in a shut-down of the packaging material provision facility. As a result, the corresponding packing station at the provision apparatus is lacking of necessary packaging material, so that the operation of the dispatch center is disturbed. In order to clear the paper jam, a manual access to the feed and/or forming rollers and the upstream chute-like preforming station is necessary.

Since the provision apparatus for the ejection of the cushion material is designed inclined downwards into a container, like a supply container or shipping carton, or on a tray, like a packing station, the mechanic of the feed unit and the forming station is not directly accessible. In order to allow an access to the feed unit and the preforming station, U.S. Pat. No. 6,918,489 B2 describes a provision apparatus according to a first embodiment, at which the forming unit is pivotable forwardly, that means in the direction of ejection to the user, relatively to a supporting frame, and a second embodiment of a calculation apparatus, on which the forming unit is pivotable backwards against the direction of ejection, away from the user. The frame with the hinge mechanism supported on it receives the weight force of the forming unit in the upper working position and in the lower loading position statically. By hinging the forming unit to the front or back, the user can remove the paper jam from the forming unit and introduce the paper strip material again over several deflection rollers. The forming unit has to be brought into its upper working position after successful threading the new paper strip before a new fabrication of packaging material can be started.

In order to avoid damage on the machine by suddenly dropping of the forming unit or even that user is injured during pivoting the heavy forming unit to the front or to the back, damping pneumatic springs are provided on both of the two embodiments of the provision apparatuses according to U.S. Pat. No. 6,918,489 B2, which inhibit a quick movement of the forming unit by their damping effect. The reloading of this provision apparatus with a new paper strip was found to be utmost laboriously in practice. On the one hand, the displacement of the forming unit between the loading position and the operation position need great physical powers. Particularly for small users, it is very hard to move the forming unit. For the case of an incorrect loading, heavy elevated weights of the forming unit are particularly bothersome, if ether too much paper material has been introduced in the feed unit, resulting in a further paper jam, or too little paper strip material has been introduced into the feed unit, so that same is not drawing the paper strip in, because the maintenance procedure of hinging down for loading and subsequent hinging up in working position has to be repeated.

SUMMARY

The invention relates to an apparatus for the provision of packaging material. Such provision apparatuses are particularly used in logistics facilities, for example, for the mail order business, in order to fill the voids between articles to be shipped and the side wall of the shipping container with a cushion material. For the production of large volumina of for example, pillow or tube-like packaging materials, paper strips can be taken as feed stock. The paper strip can be single- or multi-layered. The material of the paper strip can for example be craft or recycling paper, particularly from recycled waste paper, cardboard or carton. The usage of recycling paper is to be favored due to its particular environment-friendliness. The paper strip as stock material can be provided for example as roll or Leporello stack. Preferably, the paper strip has a width of at least 30 cm and/or 200 cm at maximum, preferably between 50 cm and 100 cm, particularly of a width of about 70 cm. The lengthwise extension of the paper strip is at least 10, 50 or 100-times, larger than the width of the paper strip. The thickness of the paper strip equals the strength of a single- or multi-layered paper material and is preferably below one millimeter.

It is an objective of an embodiment to overcome the disadvantages of prior art and particularly to provide an apparatus for the provision of packaging material that is easy to use particularly for small users and is particularly easy to equip with a new paper strip.

This task is solved by the embodiments of the independent claims 1 and 6.

According to these, an apparatus for the provision of packaging material is provided. The provision apparatus comprises a forming unit for the production of a cushion or tube-like packaging material from a paper strip and for ejecting this packaging material. Different forming means can be used for the forming for the production of the packaging material from the paper strip. The usage of a particularly chutelike forming station, particularly for transversely clinging, rolling or folding the paper strip is conceivable. Furthermore, the forming unit can have forming and/or embossing wheels in order to effectuate a compression and/or stiffening and/or fixation of the informed paper strip. Furthermore, the forming unit can optionally have a cutting unit. The forming unit can particularly be realized as described in DE 10 2012 018 867 A1, DE 10 2012 018 941 A1, DE 10 2013 015 875 A1 and/or as described in DE 10 2014 016 874 A1, wherein the disclosure of these documents should be entirely included by reference.

The forming unit has, regarded in paper feed direction, a guiding unit, a preforming station and a feed unit, one after another. The feed unit of the forming station is provided for drawing in the paper strip from a Leporello stack-shaped paper strip supply, particularly with a paper strip width of about 70 cm. The feed unit has two feed rollers opposing each other, which can be designed as forming rollers, as embossing rollers, for example as described in at least one of the patent applications of the applicant described above, for driving the paper strip by means of a motor, an electromotor, for the operation of these feeding rollers. A preforming station for transverse compression of the paper strip is positioned upstream in paper feed direction. The preforming station is designed chutelike. The transverse compression can particularly take place by folding or rolling the paper strip. The paper being fed through the preforming station to the feed unit is compressed or crushed in the preforming station from an even paper strip shape transverse to the longitudinal direction or to the paper feed direction, so that the initially even paper strip is formed into a tube-like cushion material or cushion material intermediate product.

It shall be clear that the preforming station of the feed unit is directly positioned upstream. The preforming station is aligned essentially alignigly or aligned relatively to the feed unit, so that the paper material undergoes no or only a slight deflection of less than 45%, or less than 30%, or less than 15%, particularly less than 10%, during the crossover from the preforming station in the feed direction. The paper feed unit and the preforming station provisioned upstream, being aligned alignigly or being aligned essentially alignigly to each other, are defining a mutual forming feed direction. Furthermore, the forming unit has a guiding unit, like a sliding edge or a deflection roller, being directly positioned upstream in paper feed direction, wherein same guiding unit is provided for the alignment of the paper strip for the preforming station. The paper strip runs flat, undeformed, over the feed unit. The preforming station, the feed unit and the guiding unit are collectively defining an elongated feed path for the paper material through the forming unit. The guiding unit is positioned upstream, alignigly, in relation to the preforming station and to the feed unit, if applicable. The path defined by the guiding unit together with the preforming station and the feed direction is straight or at least essentially straight, wherein a minor curvature with a curve radius larger than the distance from the feed unit to the guiding unit can be provided.

The provision apparatus furthermore has a frame, on which the forming station is supported pivotively between a working position and a loading position. The pivoting axis extends transversely to a vertical direction relatively to the ground, on which the frame is standing. If the frame is positioned at a wall, the floor of the room can be considered as a reference, against which the vertical lines are defined. The pivoting axis of the support of the forming unit extends at the frame transverse to the ejection direction. The pivoting axis can have an alignment, which corresponds to the paper strip transverse direction in undeformed state and/or corresponds to the extension direction of the guiding unit. In operation, the forming device is directed sloped and/or directed forwardly with an aligned downwards for the injection, particularly ejecting or dropping, of the packaging material. The outlet opening of the forming unit is aligned in such a way that packaging material from the forming station is ejected into a container, for example a package material supply container, a shipping carton or such, or on a tray, like a packing station.

The outlet opening of the forming can be arranged above 1 m, particularly above 1.5 m of height and preferably below 2 m of height, relatively to the ground on which it stands. The forming station, particularly the preforming station and/or guiding unit, in loading position is lowered relatively to the operation position. The position of the forming unit, particularly the vertical position of the preforming unit and/or the vertical position of the guiding unit of the forming unit, is positioned higher regarded in operation position than in loading position, so that the access to the forming unit, particularly the preforming station, the guiding unit and/or the feed unit in the loading station, is significantly simplified for the user. Thus, the manual introduction of paper into the forming unit, into the feed unit, possibly into the preforming station and eventually in, through or on the guiding unit is significantly simplified. The motor of the feed unit according to an embodiment is activatable in the loading position. The feed unit in loading position is provided particularly exclusively for the feed and/or forming operation, with paper feed direction according to the ejection direction. By that, it can be achieved that, in loading position, directly after loading the feed unit or the forming unit with a fresh paper strip, for example, after a paper jam, the tear-off of the paper strip or after processing a previous paper strip completely, a user can activate the forming unit for drawing in the paper strip or forming and ejecting the packaging material, if applicable, still in loading position. Preferably, the user does not have to move the forming unit strip into operation position for the initial activation after a repeated loading with the paper before that. A seamless restart can be assured undisturbedly, in that the paper strip is drawn into the forming unit directly after the loading.

According to one embodiment, the forming unit has on an outlet opening for the packaging material on its front side and the forming unit is pivotable backwards from the operation position into the loading position. Furthermore, the forming unit has an additional initialization switch for activating the motor of the feed unit in the loading position. The initialization switch is arranged at the forming unit and, only in the loading position, accessible at the rear side of the forming station. The front side or the rear side, respectively can be defined relatively to the frame. The paper strip supply, preferably the Leporello stack, is arranged at the rear side of the frame. The filling container or the tray to be filled, which is supplied from the outlet opening or the ejection opening with the packaging material, is arranged at the front side in relation to the frame. The outlet opening is therefore located at the front side and the guiding unit on the rear side. The forward direction corresponds to the paper feed direction, according to the standard operation. The initialization switch accessible on the rear side is provided additionally to one or several operation switches for the normal operation of the provision apparatus. For the normal operation of the provision apparatus, the food pedal switch in front of the provision apparatus and/or a hand switch, for example, at the front side of the frame can be provided. The paper strip and the frame represent an obstacle for the user, particularly with the basic material in the form of the paper strip with a transverse width of more than 50 cm, for example about 70 cm, so that the user cannot access the activation switch for the normal operation from the loading position for a forming unit for the loading of the forming unit with a paper strip that is pivotable backwards and downwards. He needs to call for a second user or needs to distant from the loading position. The additional switch for the activation of the motor in loading position can for example be denoted as initialization switch. The initialization switch is arranged at the top side of the forming device. Preferably, the initialization switch is arranged above the feed unit and/or the preforming station. The initialization switch is arranged at a top surface of the forming unit, whose surface normal is directing to the rear side, particularly sloped downwardly.

According to one embodiment, the forming unit is designed to operate the motor with high load, particularly higher load than a normal operation and/or with at least 60%, at least 50% or at least 90%, particularly up to 100% of the full load, on activation of the motor in the loading position, particularly by means of the initialization switch. Preferably, a constant feed velocity is requested on activation of the initialization, particularly of an initialization switch, whereby a maximum motor torque is exerted during the loading. It is thereby assured that the maximum performance of the motor or at least a high performance of the motor for drawing in or forming the paper strip, if applicable, is provided on initialization activation of the motor. It is thereby prevented that a paper jam is occurring on initialization of the operation after loading with the new paper strip, for example, if more paper has been introduced than necessary or that an inadequate drawing-in of the paper strip is occurring when introducing too little paper material in the feeding unit.

According to one embodiment of the provision apparatus according to an embodiment, a manual introduction axis for introducing the paper strip into the feed unit, particularly its feed and/or forming rollers, is provided in the loading position. The drawing-in is executed from the rear side of the provision apparatus.

According to one embodiment, the forming unit has a securing switch having a release state, in which he allows an activation of the motor, particularly in loading position and/or by the initialization switch. Furthermore, the securing switch has a securing state, in which he can inhibit an activation of the motor in the loading position. The securing switch can for example be designed as magnet switch or capacity sensor. Particularly, the securing switch only adopts a release state in a closed position of a tool-free removable protective cover for covering the feed unit, the preforming station and/or the guiding unit. Such a protective cover can be provided in order to ensure, in combination with a securing switch, that an accidental activation, like an initialization activation, of the motor is always excluded, if there is a possibility that a user is reaching into the introduction area of the provision apparatus, that means into the forming unit or its feeding unit, preforming station or guiding unit, respectively.

According to another embodiment, which is combinable with the previous embodiments, an apparatus for the provision of packaging material comprises a forming unit for the production of a cushion and/or tube-like packaging material from a paper strip and for ejecting the packaging material. The forming unit has a feed unit for pulling in the paper strip from a preferably Leporello stack-shaped paper strip supply, which has two feed rollers, particularly forming rollers and/or embossing rollers, opposing each other for driving the paper strip and a motor, an electromotor, for the operation of the feed rollers. The forming unit can be realized as described in DE 10 2012 018 867 A1, DE 10 2012 018 941 A1, DE 10 2013 015 875 A1 and/or DE 10 2014 016 874 A1, wherein the disclosure of these documents is included by reference. Furthermore, the forming unit provides a chute-like preforming station being positioned upstream of the feed unit in the feed direction for transverse compression, preferably folding or rolling, of the paper strip, as well as a guiding unit, like a sliding edge or a deflection roller, being positioned upstream of the preforming station in the paper feed direction for aligning the paper strip for the preforming station. The guiding unit defines, together with a preforming station and a feed unit, an elongated feed path through the forming unit. Furthermore, the apparatus for the provision of packaging material comprises a frame, on which the forming unit is pivotably supported between a working position and a loading position. In the loading position, the forming unit is aligned downwards with an ejection direction for ejecting the packaging material particularly into a container or on a shelf. Regarding details for the forming unit or the frame, it is referred to the above explanations. In loading position, the forming unit, particularly the preforming station and/or the guiding unit, is lowered relatively to the working position.

According to this embodiment, a preload force, like a spring preload force, is acting against the weight force of the forming unit, in the loading position. The forming unit is supported at the frame by means of the pivoting bearing, so that the pivoting bearing is at least partly receiving the static weight force, which acts downwards in the vertical direction. In the loading position, the forming unit is positioned at an at least relatively to the working position lowered, particularly the lowest possible, position. In order to bring the forming unit from the loading position in a different position, particularly the working position, the circumferential direction has to get against its weight force. By providing the preloading force, the lifting of the forming unit can be facilitated significantly. It shall be clear that the term preload force has to be understood in a broad sense and also includes preload torques. In the loading position, the preloading force, particularly the spring preloading force, causes a weight release of at least 25%, at least 50%, at least 75% or even at least 90% of the weight force of the forming unit. The preload force preferably acts in at least one pivoting range starting from the loading position, being larger than 10°, larger than 30° or larger than 45° and/or being smaller than 60° or smaller than 50°.

According to one embodiment, a preload force, like a spring preload force, can also act against the weight force of the forming unit in working position. The preload force acting in working position is present at least to a small extent. The pivoting bearing is designed in such a way that the balance point of the forming unit is located in the working position below a highest possible point. In other words, the pivoting motion is designed in such a way that the movement of the forming unit from the working position of the forming unit has to be initially lifted slightly so that the assembly of the forming unit stands stable in the working position. In the working position, the preload force, particularly the spring preload force, causes a weight relief of less than 50%, particularly less than 25%, preferably less than 10% and/or more than 1%, preferably more than 5% of the weight force of the forming unit. By providing a preload force against the weight force in the working position as well as in the loading position of the forming unit, a secure and particularly easy usage of the provision apparatus can be assured. The preload force acts in at least a pivoting range, starting from the working position, being larger than 5° or larger than 10° and/or being smaller than 30° or smaller than 45°.

According to one embodiment of the provision apparatus, the forming unit is supported with a torsion spring coupling, like a claw coupling. The torsion spring coupling has at least one elastic element, preferably two, three, four, six, eight, twelve or more elastic elements, like elastomer objects, for example rubber pads, whose elastic restoring force provides at least partly a preload force for the loading position and/or the working position, as applicable. The usage of a torsion spring coupling allows a practically maintenance-free design of the pivoting bearing of the forming unit with respect to the frame. Furthermore, a torsion spring coupling can advantageously be designed to the effect that it only allows a limited pivoting range of for example less than 180°, particularly less than 90°. The torsion spring coupling can be realized preferably with functionally and/or structurally integrated pivoting end stops. With the torsion spring coupling, it can be assured that the available pivoting range of the forming unit is always within a valid range.

According to one embodiment of the provision apparatus, which is combinable with the previous, the provision apparatus further comprises a tension spring or a particularly movable, supported on a floating bearing, counterweight for the provision of at least a part of the preload force in the loading position. The tension spring and/or the counterweight are arranged in an inner cavity of the frame. Preferably, the provision apparatus uses both, a torsion spring coupling, as described above, and a tension spring and/or a counterweight, so as to provide a particularly high preload force in loading position, wherein the preload force in the loading position can be significantly, particularly 5 or 10 times, higher than in the working position.

According to one embodiment of the provision apparatus, which is combinable with the previous, a guiding member-like security band is holding the forming unit in the loading position. The security band binds the forming unit in the loading position downwards against a further pivoting. A securing band can for example be made of steel. Preferably, the securing band is mounted fixedly at the forming unit and interacts with a securing pin aligned fixedly at the frame. Alternatively, the securing band is fixedly mounted at the frame and interacts with a securing pin which is mounted fixedly at the forming unit.

According to one embodiment of the provision apparatus, same comprises a paper strip supply formed by a paper roll or Leporello stack particularly being arranged between two feet and/or legs of the frame opposing each other. The paper strip supply is arranged at the rear side of the provision apparatus, behind the frame, wherein in front of the frame, opposing the paper strip supply, a packing station can be arranged. With such an assembly, different personnel can access the provision apparatus particularly well for packing at the front side or loading at the rear side. A paper strip supply formed for example as Leporello stack can be held stable in the transverse direction by the feet and/or legs of the frame.

BRIEF DESCRIPTION OF THE DRAWINGS

The system and method may be better understood with reference to the following drawings and description. Non-limiting and non-exhaustive embodiments are described with reference to the following drawings. The components in the drawings are not necessarily to scale, emphasis instead being placed upon illustrating the principles of the invention. In the drawings, like referenced numerals designate corresponding parts throughout the different views.

DETAILED DESCRIPTION

Figure 1:
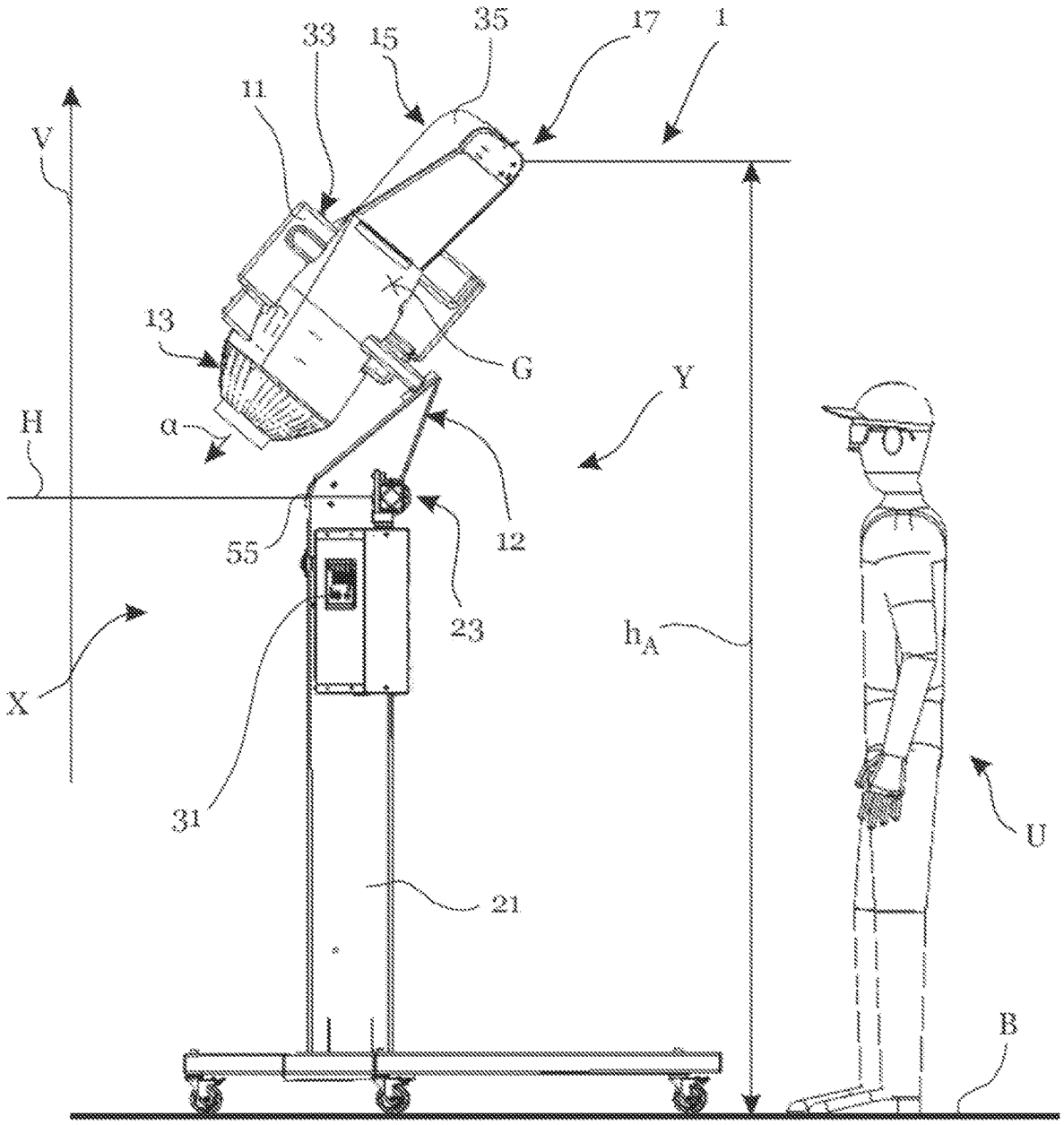
FIG. 1 is a side view of the provision apparatus according to an embodiment in working position.

One embodiment of the apparatus for the provision of the packaging material according to the apparatus shown in the Figures is generally attributed with a reference numeral 1. The provision apparatus comprises as components a forming unit 11 and a frame 21, on which the forming unit is pivotably supported.

Figure 3A:
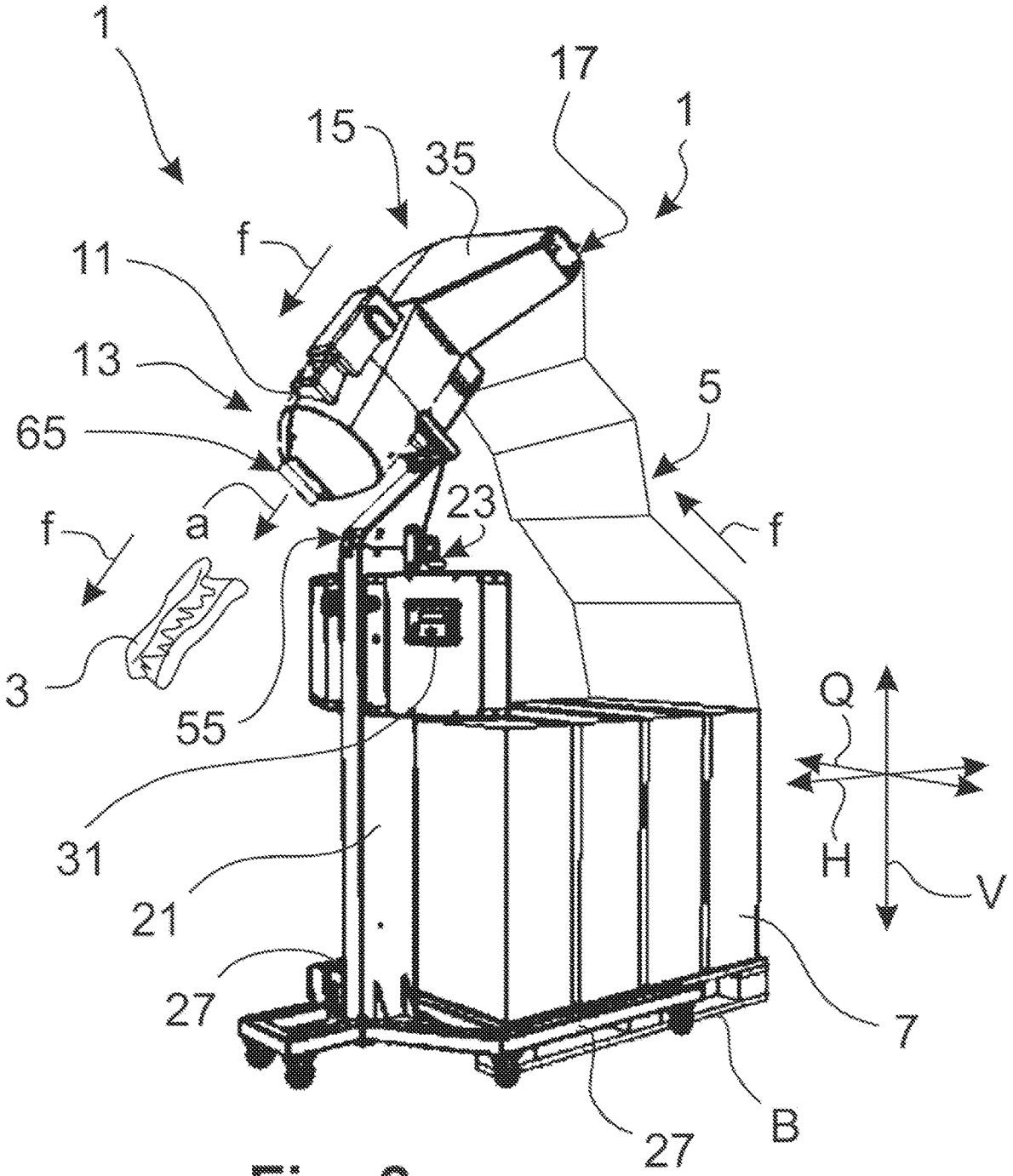
FIG. 3A is a perspective front view of the provision apparatus according to an embodiment according to FIG. 1.

The functional principle of the provision apparatus according to one embodiment can be understood from FIG. 3A.

The provision apparatus 1 has a Leporello stack-shaped paper strip supply 7. The forming unit 11 draws in a paper strip 5 from the paper strip supply 7. In the forming unit 11 a for example cushion-shaped packaging material 3 is fabricated from a paper strip 5. The forming unit 11 is producing cushion-shaped packaging material 3, as shown in FIG. 3A, which has a specific cushion product length and is being cut by a cut from a following paper strip 5, or, if the forming unit produces an endless, tube-like packaging material (not shown in detail here).

The provision apparatus 1 can, as shown, have a mobile frame standing on a floor B or such. Alternatively, it is possible to use a wall-fixed frame. The paper strip 5 and respectively the paper supply 7 have a certain transverse width in transverse direction Q. The width of the paper strip 5 is about 70±5 or 70±0.5 cm. It is also conceivable that a paper strip has a narrower width of less than 70 cm, for example only about 50 cm or 30 cm, or that the paper strip 5 has a higher width of 100 cm, 150 cm, or 200 cm. The frame 21 extends in the vertical direction V upwards, relatively to the floor B and carries the forming unit 11 at its upper end. The packaging material 3 is ejected from the forming unit in the horizontal direction H to the front side and in the vertical direction V downwards, for example, into a supply container, a shipping container, carton, or on a tray, like a packaging working place (not depicted in detail here).

For the operational activation of the cushion product provision apparatus, the user U can activate a control panel 31 and/or a foot switch (not depicted in detail here) at the front side X of the apparatus 1. Depending on the settings of the provision apparatus 1, the activation by the panel 31 and/or the foot switch can initiate producing one or several cushion products of predetermined length or the production of an endless, packaging material tube to be torn off.

In order to keep the front side X of the assembly, that means in the area of the forming unit 11 or the frame 21, clear for the shipping goods to be cushioned in shipping containers, the paper strip supply 7 is arranged at the rear side Y of the provision apparatus 1 that means behind the forming unit 11 or the frame 21, respectively. The supply 7 can be realized by one or several Leporello stacks being for example arranged on a pallet, like a Euro-pallet. Instead of the Leporello stack, the paper strip 5 can be available coiled on a roll, wherein the rotation axis of the roll is extending in transverse direction Q, so that a draw-off from the roll is essentially executed in the same direction and orientation as from the Leporello stack 7.

Figure 7:
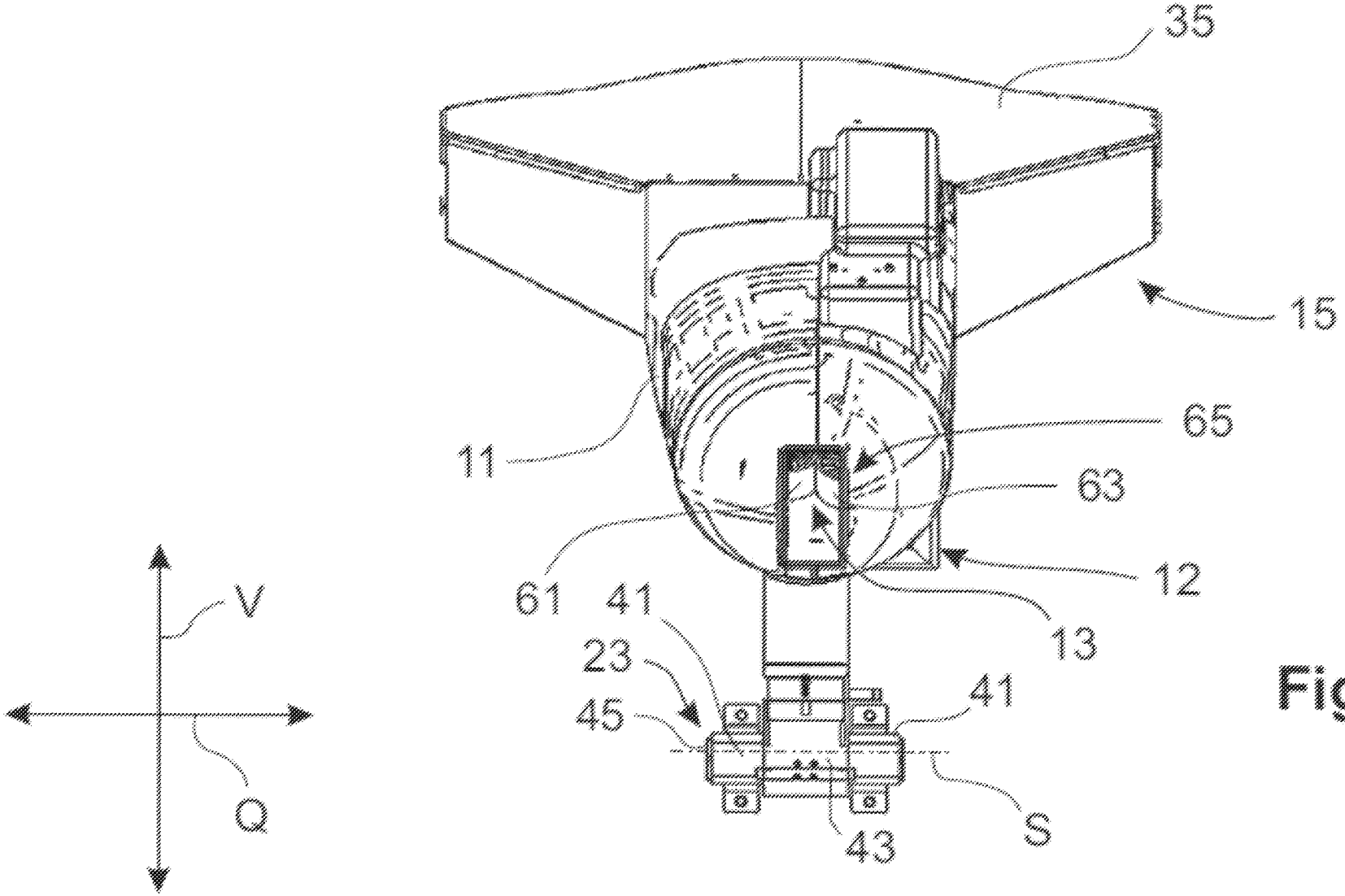
FIG. 7 is a front view of the forming unit with pivoting bearing.
Figure 8:
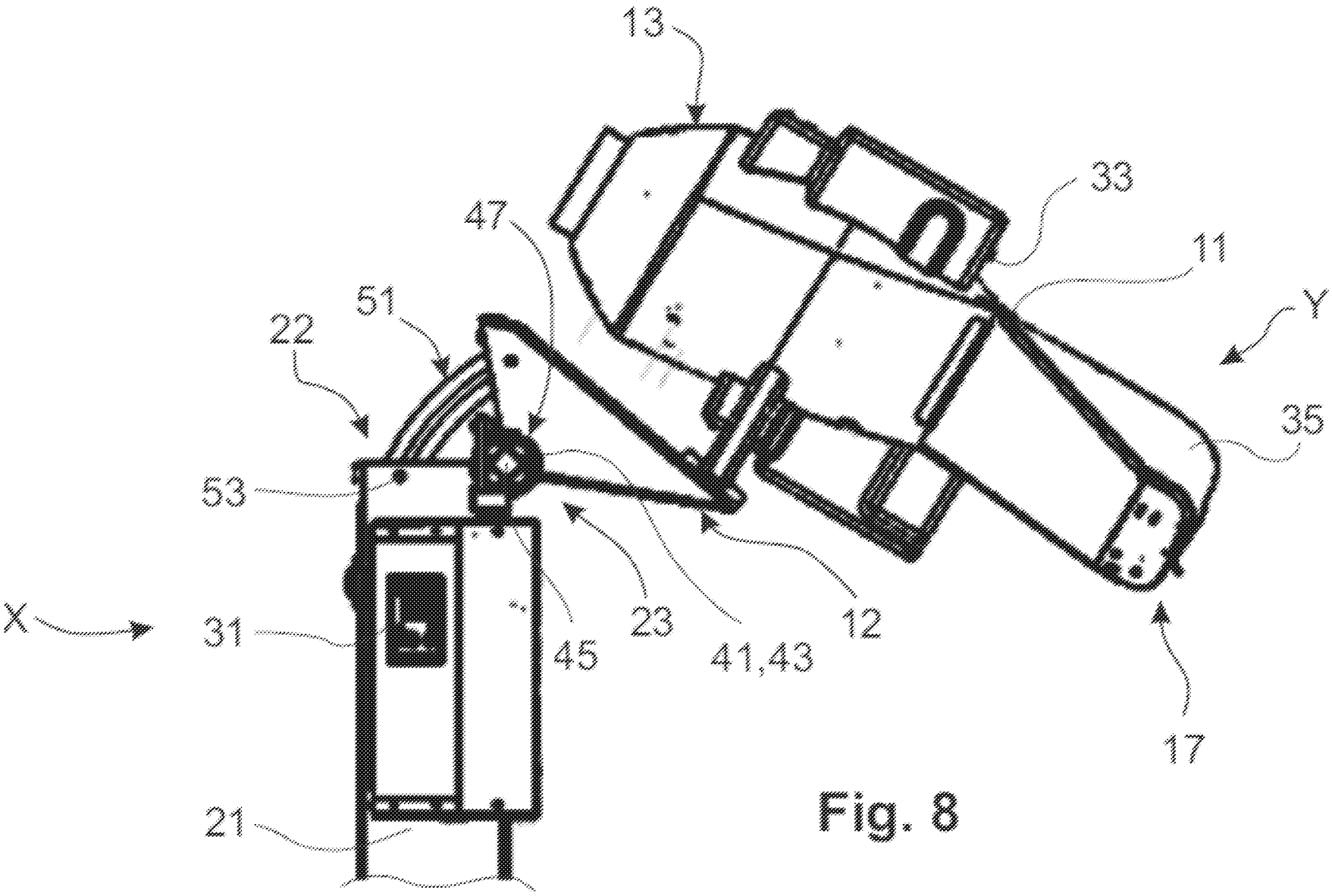
FIG. 8 is a detail view of the provision apparatus according to an embodiment in the loading position according to FIG. 2 with a view to the pivoting bearing.

The forming unit 7 comprises a motor driven feed unit 13 for drawing in the paper strip 5 from the paper strip supply 7. As shown in FIG. 7, this feed unit 13 can have feed rollers 61, 63 opposing each other, wherein at least one of the feed rollers 61 is driven. The feed rollers 61, 63 can be formed flat, convex and/or gearlike. Feed rollers 61, 63, particularly those with gear shape, can be equipped for the forming of the paper strip, particularly for the reproduction of punch cards and/or imprints into the packaging material 3, for the forming of the paper strip. The feed rollers 61, 63 can engage with each other, in order to exert lateral pressing forces on the paper strip 5 or the packaging material, respectively, in order to increase the feed effect or a forming effect, if applicable. By the feed rollers 61, 63, the paper is fed through the outlet opening 65 in the ejection direction and is ejected from the forming unit 11. It shall be clear that, for example, for an embodiment of a provision apparatus with a forming unit 11 according to DE 10 2014 016 874 A1, the forming unit 13 can have several pairs of feed and/or forming rollers, like a first pair of feed rollers opposing each other for pulling in the paper strip and a second pair of feed rollers for ejecting packaging material.

The course of the paper, that means the paper strip 5 or the packaging material 3, respectively, from the paper strip supply 7 through to the outlet opening 65 defines a paper feed direction f. Within the forming unit 11, an elongated feed path p is defined by a path of the paper strip in the paper feed direction f from the guiding unit 17, which can be realized as deflection roller 18 according to FIG. 3B, through the chute-like preforming station 50 and the feed unit 13 through to the outlet opening 65. The feed path p of the embodiment depicted essentially corresponds to the ejection direction a. It is also conceivable that the feed path p differs from the ejection direction a, for example, if a deflection shall be provided at the outlet 65 of the forming unit 11.

A preforming station 15 is provided positioned upstream the feed unit 13 in paper feed direction f, which can be realized here chute-like by the housing. By feeding the paper strip 5 through that preforming station 15, the lateral outer edges of the paper strip 5 are guided against the narrowing tube walls of the preforming station 15 and thereby folded or rolled inwardly, respectively, so that a tube-like cushion pre-material is formed. The extension of the paper compared to the original width of the paper strip 5 in transverse direction Q is significantly reduced by the preforming station 15.

Before the paper strip 5 is entering the preforming station 15 in the paper feed direction f, the paper strip is aligned by a guiding unit 17, so that an elongated feed path p is formed by the forming unit, counteracting a rip-off from the paper strip. Instead of the deflection roller 18, a stationary slide edge with good sliding properties compared to the paper strip 5 can be provided as guiding unit 17.

Figure 2:
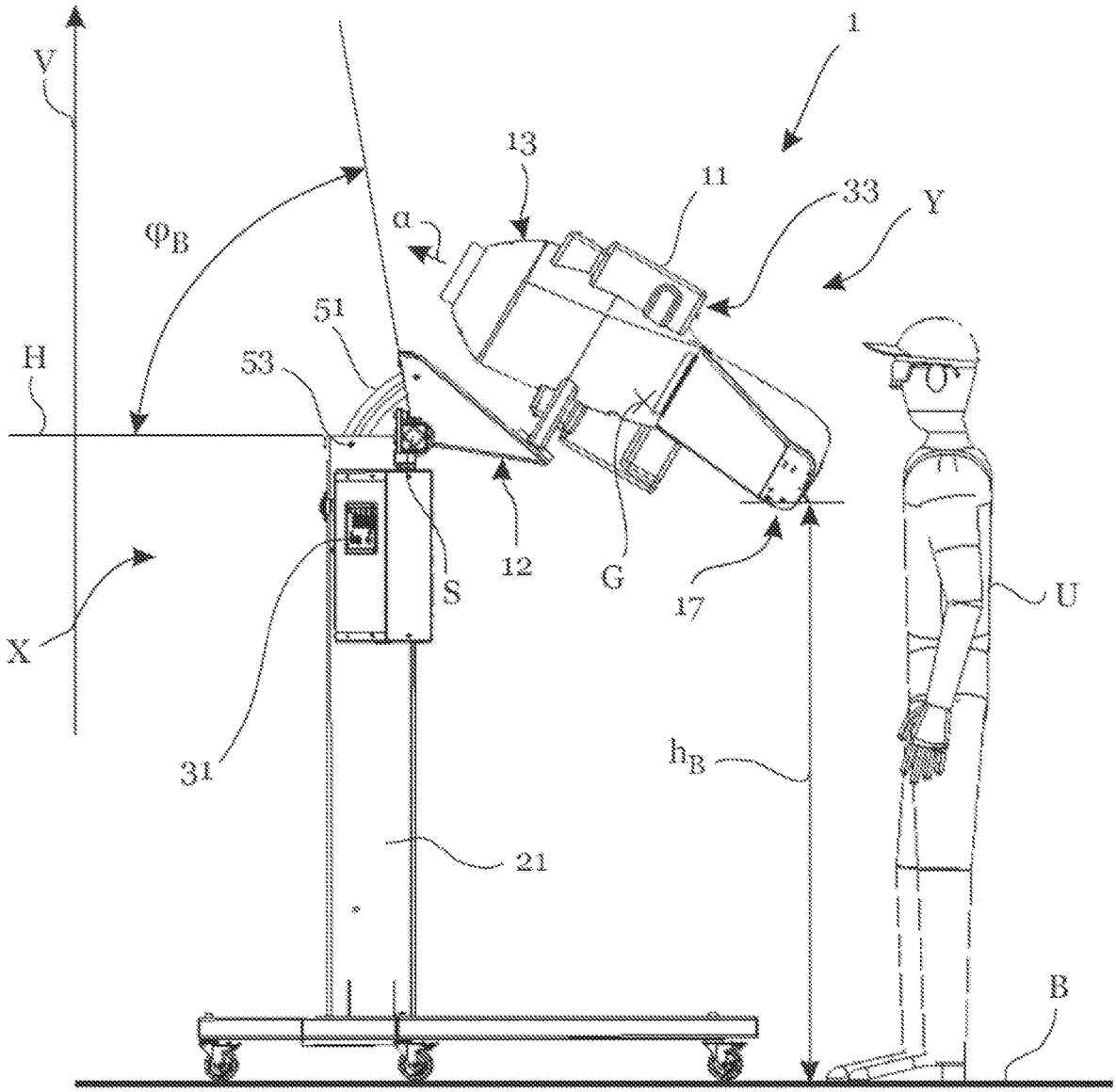
FIG. 2 is a side view of the provision apparatus according to an embodiment according to FIG. 1 in the loading position.
Figure 3B:
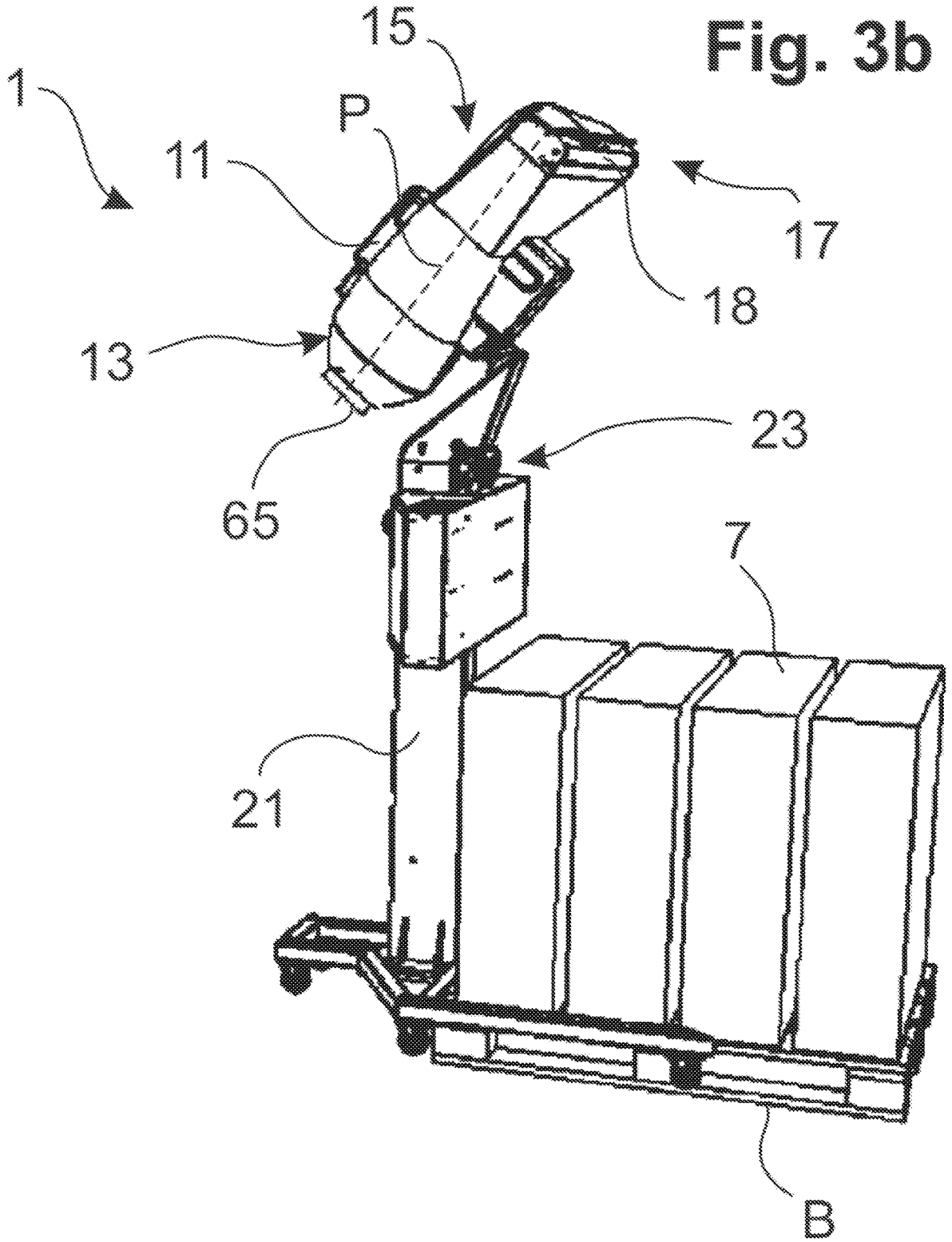
FIG. 3B is a perspective view of the provision apparatus according to an embodiment according to FIG. 1.
Figure 4:
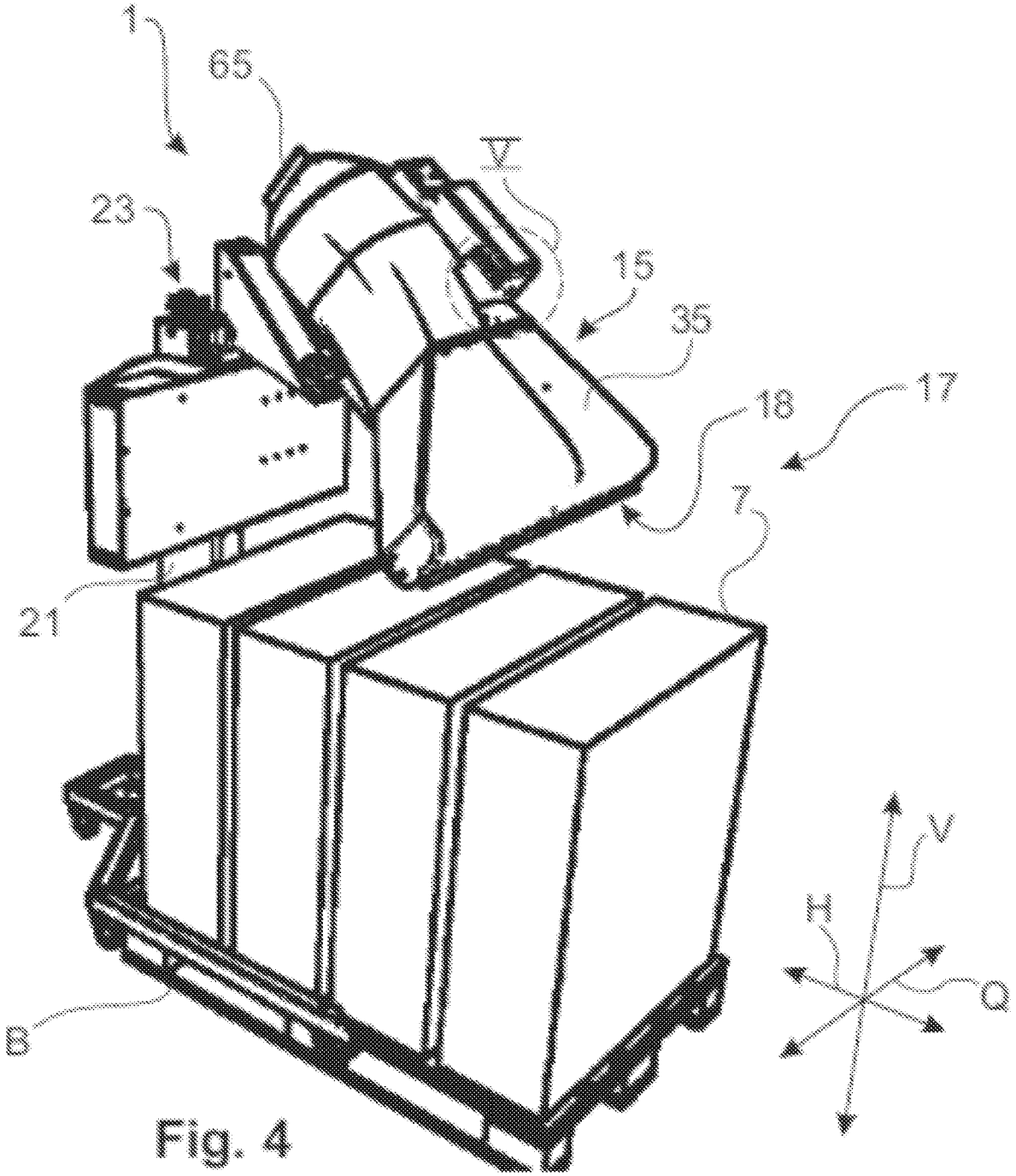
FIG. 4 is a perspective rear view of the provision apparatus according to an embodiment according to FIG. 2 in the loading position.

The forming unit 11 can be hinged backwards to the rear side Y from the working position depicted in FIGS. 1, 3A and 3B. When hinging away the forming unit 11 from the working position, the forming unit 11 moves around a frame stationary pivoting bearing 23. The details of the pivoting bearing are further described in detail, particularly with regard to FIGS. 6 of 8, below. The forming unit 11 can be brought into a loading position by pivoting around the pivoting bearing 23, which is for example shown in FIGS. 2 and 4. The forming unit 11 is essentially fixedly supported relatively to the frame 21, with respect to an axis defined in vertical direction V. Starting from a working position (FIG. 1), the forming unit 11 can be crossed in the loading position (FIG. 2) at a maximum pivoting angle φB. The pivoting angle is larger than 45° and/or smaller than 135°. Particularly, the maximal pivoting angle is smaller than 90° and can be around 80°.

The balance point G of the forming unit 11 is displaced downwards in the loading position relatively to its position in the working position in the vertical direction V. The guiding unit 17 is, starting from the working position, displaced in vertical direction V downwards, mainly from the working height hA to the loading position hB. The loading height hB is preferably between 80 cm and 200 cm, preferably between 100 cm and 175 cm above the floor B, on which the paper supply 7 or the user U can stand on the rear side Y of the apparatus 1.

The forming unit 11 is held stationary at the frame 21 in the working position by a fastener or lock 55, respectively. The lock 55 has to be released first in order to be able to turn the forming unit 11 around the pivoting axis S of the bearing 23. The forming unit 11 is secured in the loading position (FIG. 2) rotationally movable, particularly downwards, by a securing band 51, which is counteracting with a securing pin 53 being stationary to the frame 21 and limiting a maximal turning movability of the forming unit 11 around the pivoting bearing 23.

Figure 13:
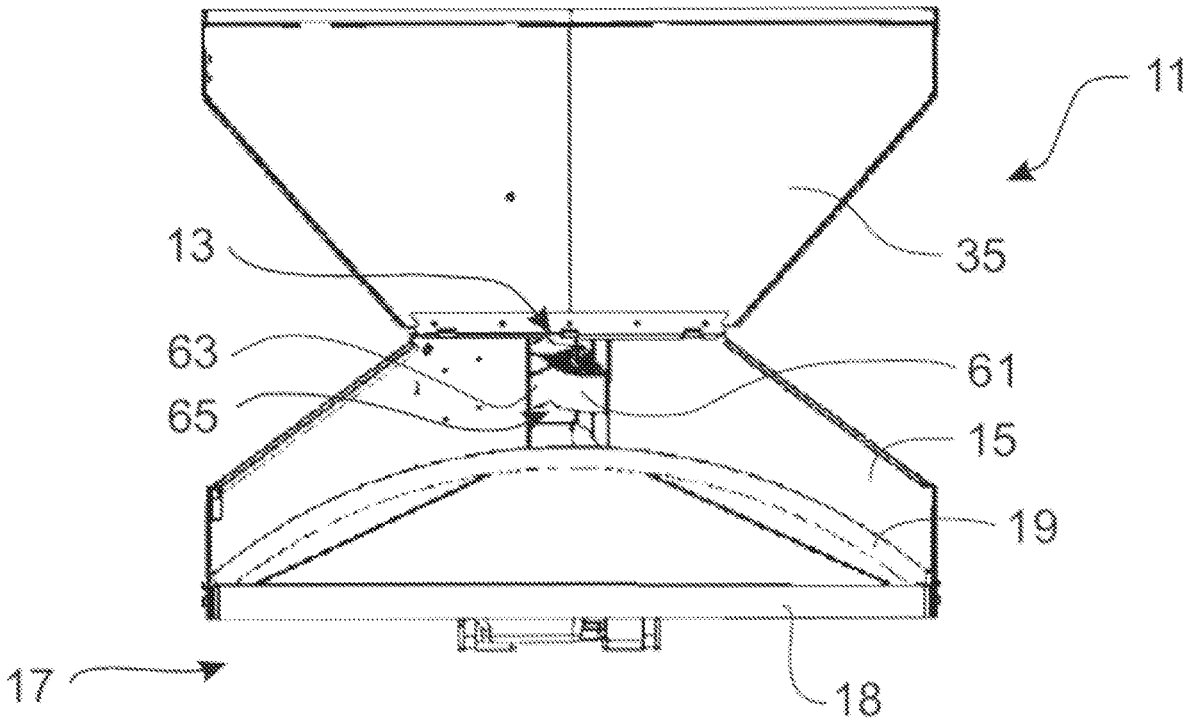
FIG. 13 shows a rear view of the opened forming unit according to FIG. 12.

In the loading position, the guiding unit 17 is approached close to the Leporello stack 7 (FIG. 4), in that a user U standing behind the Leporello stack 7 can introduce a paper strip 5 from the paper strip supply 7 into the forming unit 11 at the rear side Y without notable effort. According to one embodiment according to the Figures, the user U has to remove the securing cover or the cover 35 from the forming unit 11, which covers the guiding unit 7, the preforming station 15 and the inlet of the feed unit 13. The cover 35 can for example be crossed upwardly of a hinged joint. The cover 35 is shown in its closed position in FIGS. 1 to 7. The forming unit 11 is, for safety reasons, provided with a securing switch not further detailed here, capturing whether the cover 35 is in a closed position. If the cover 35 is removed from the closed position, the securing switch 36 causes that a feed and/or forming operation of the forming unit is safely inhibited (FIG. 13). The securing control in its securing state can for example trigger that the drive motor of the feed unit 13 does not receive any driving current. The provision apparatus 1 can therefore only be brought into an operational feed and/or forming operation, if the cover 35 is closed so that an axis of the user U into the inside of the forming unit 11 is certainly excluded so that the user U is not exposed to any danger of injury by the feed unit 13.

Figure 5:
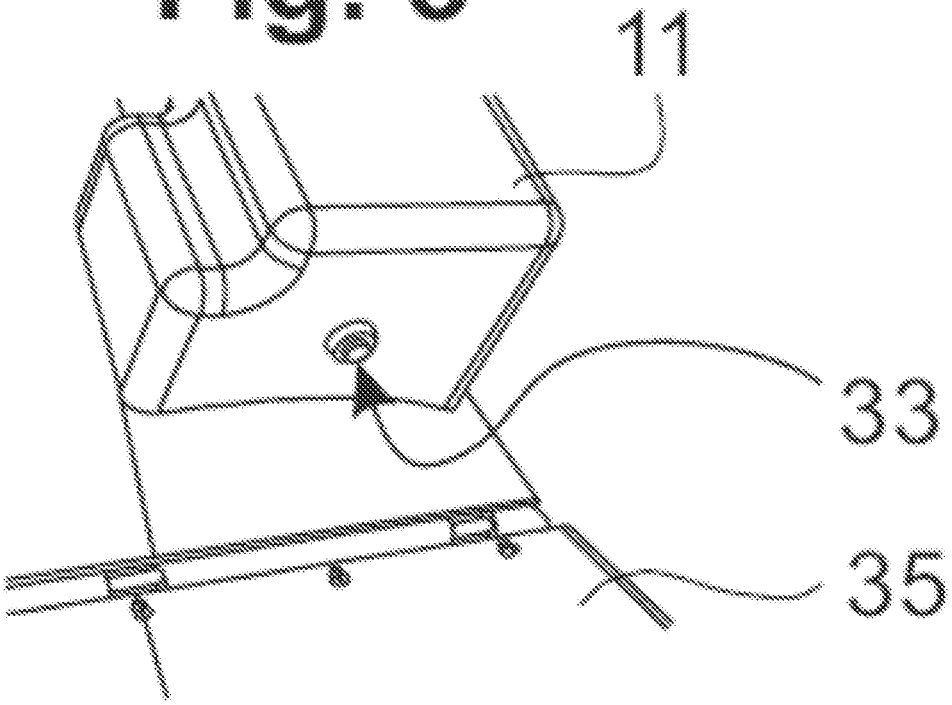
FIG. 5 is a detailed view of the provision apparatus according to an embodiment show in FIG. 4 with a view to the initialization switch.

As shown in FIG. 5, an initialization switch 33 is provided at the rear-sided top side of the forming unit 11, which only can be activated by a user standing at the rear side Y of the provision apparatus 1 and only in the loading position of the assembly 11. The user standing at the rear side Y of the provision apparatus 1 has virtually no access to the control panel 31 at the front side X and the foot switch (not depicted) positioned at the front side X. When the user is activating the initialization switch 33, the motor of the feed unit 13 is driven with high performance in order to draw in a paper strip provided by the user U, under avoidance of paper jams, into the forming unit so that a normal operation of the provision apparatus 1 can be executed again, subsequently.

Figure 12:
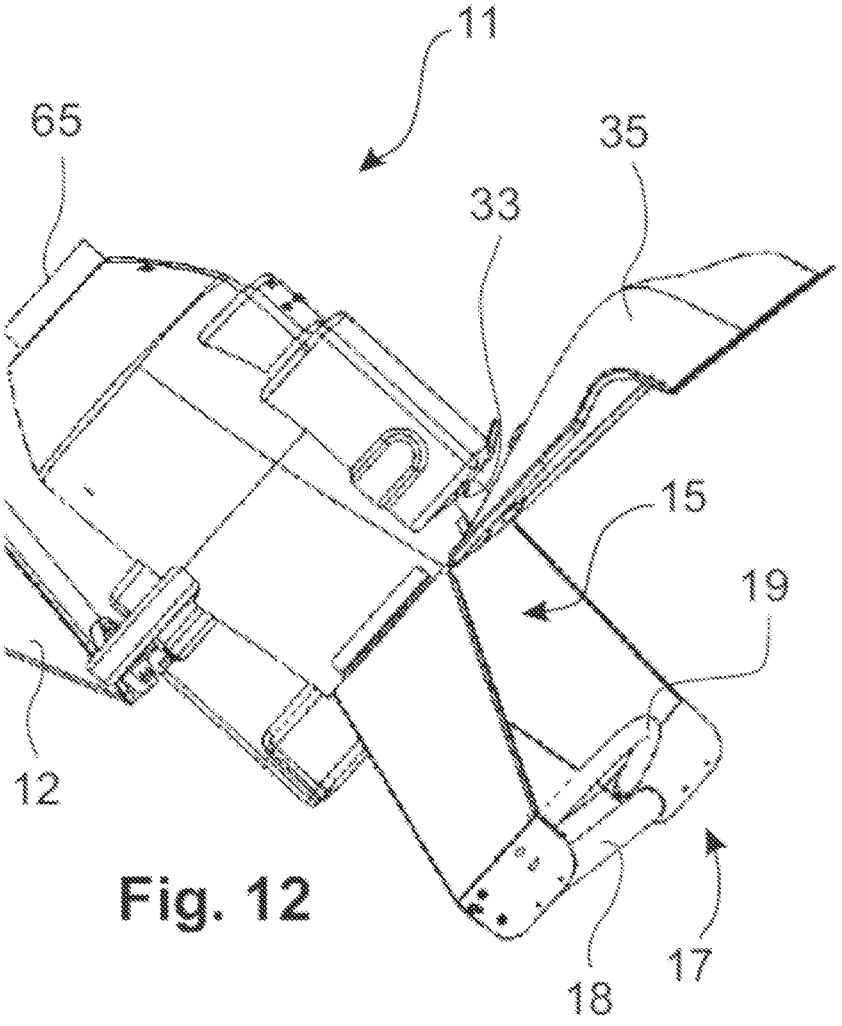
FIG. 12 is a forming unit in the load position with opened cover.

FIGS. 12 and 13 show a forming unit 11 with opened cover 35. At one embodiment, the cover 35 is arranged above the guiding unit 17 at a preforming station 15 following it in paper feed direction f. The cover is supported at the forming unit 11 with a joint, which allows a pivoting of the cover from its closed position. The cover can be locked in an open position for example by a magnet fixture.

The guiding unit 17 comprises a deflection roller 18 and a guiding shackle 19 arranged behind it. The guiding shackle 19 extends convexly bent or upwards at the inlet of the forming station in order to introduce a uniform folding of the paper strip in the preforming station narrowing chute-like 15. Two infeed or feed rollers 61, 63 are arranged in paper feed direction f following the preforming station, in order to feed the paper strip 5 in or through, respectively, the forming unit.

Figure 11:
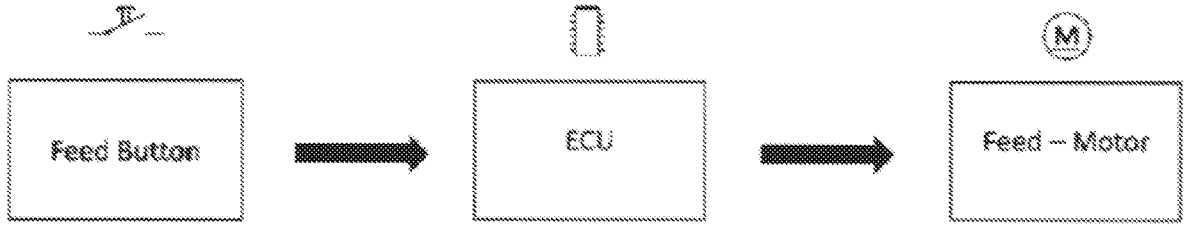
FIG. 11 is a schematic representation of the initialization procedure.

The initialization process is shown schematically in FIG. 11. When the initialization switch or feed button 33 is pressed, this can be detected by the electric control unit (ECU) for example in a housing at the control panel 31 as initialization control signal, which is initializing an activation of the feed motor.

Figure 6:
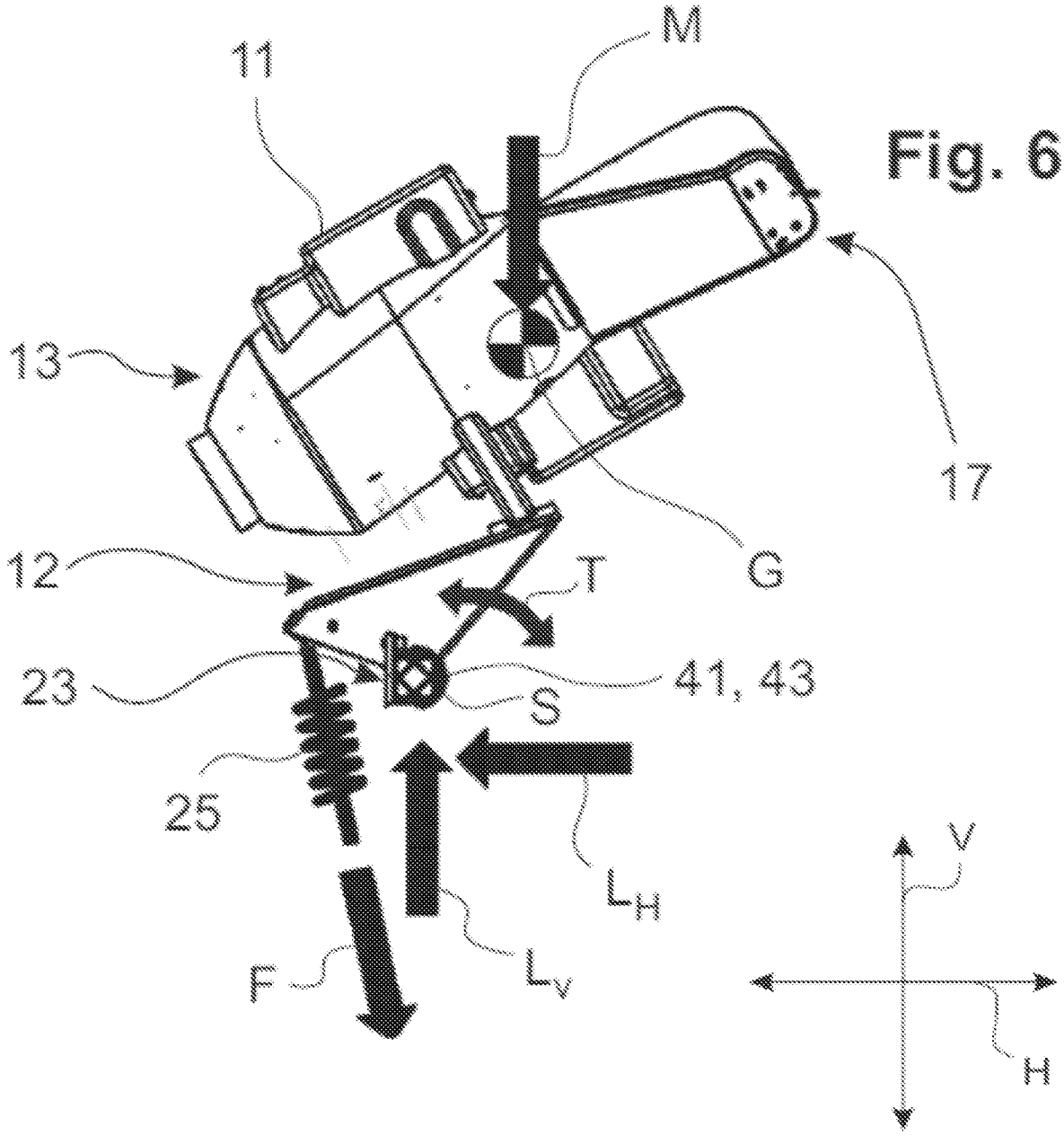
FIG. 6 is a schematic representation of the acting forces between the forming unit and the frame.
Figure 9:
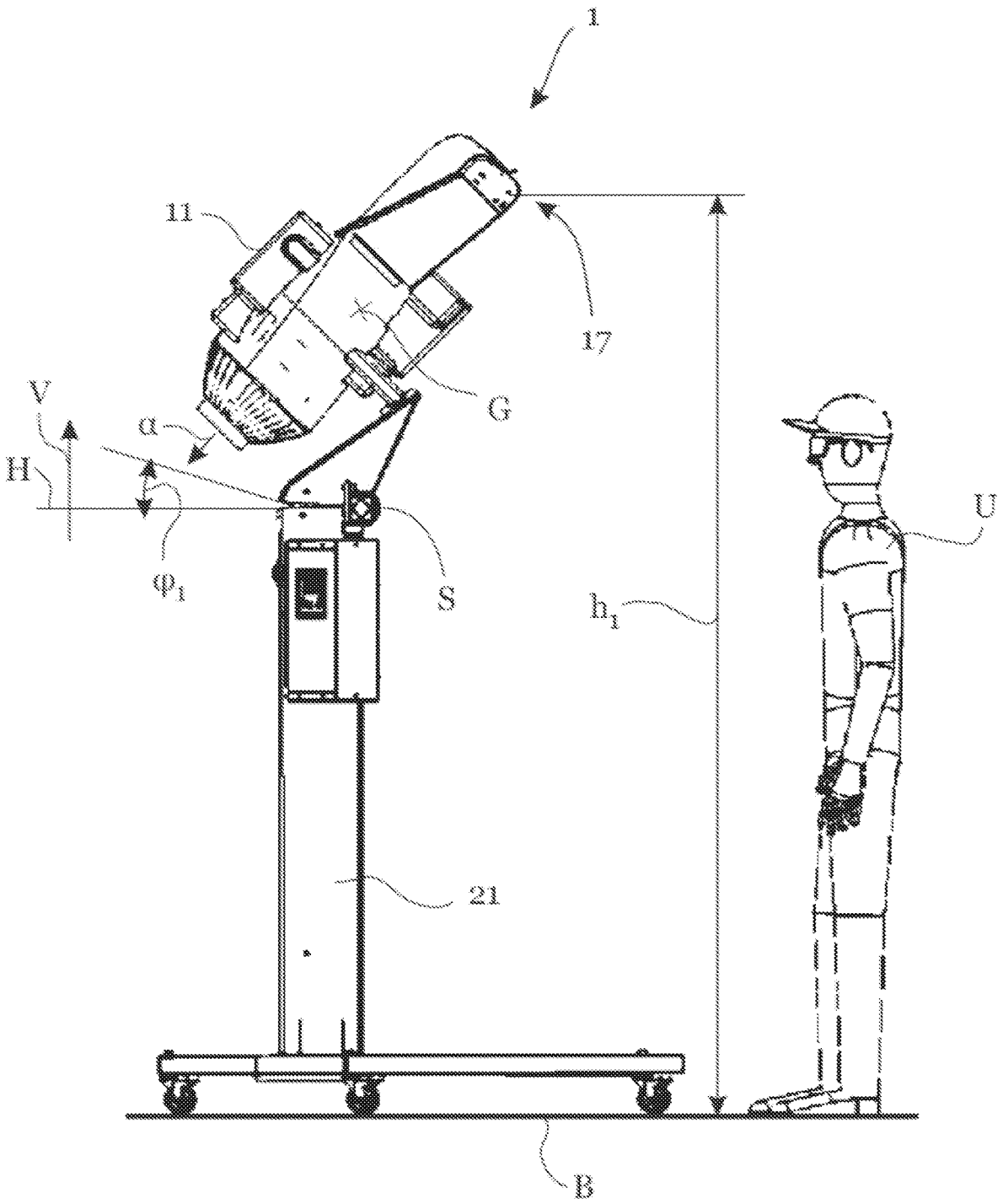
FIG. 9 is a side view of the provision apparatus according to FIG. 1 in a first intermediate position.
Figure 10:
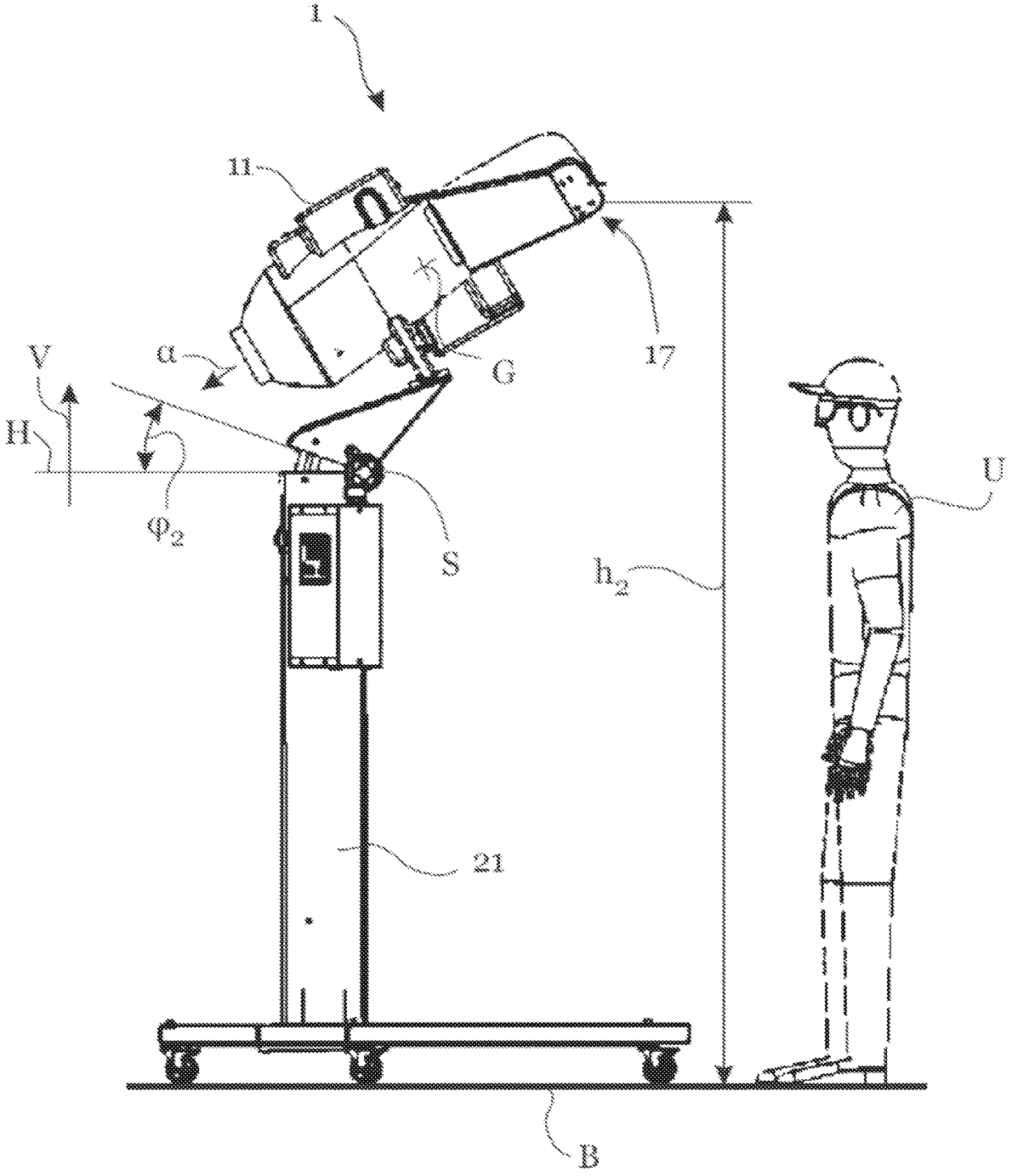
FIG. 10 is a side view of the provision apparatus according to an embodiment according to FIG. 1 in a second intermediate position according to a labile counterweight.

In FIG. 6, the forces which act between the forming unit 11 and the frame 21 (not depicted) are shown. The forming unit 11 has a mass as weight force M in vertical direction V downwards, starting from its balance point G. The weight force M of the forming unit 11 is received directly or indirectly by the frame 21, which carries the forming unit 11. The downwards movement of the forming unit 11 to the rear direction counteracts a tension spring 25 with a spring force F. The pivoting bearing 23 being designed as torsion spring coupling acts against the weight force M of the forming unit 11 with an elastic torsional moment T, generally a restoring moment, in both the working position (FIG. 1) and in the loading position (FIG. 2). If the fastener 55 is released, the forming unit 11 takes the first intermediate state or stable balance state shown in FIG. 9. In the first intermediate state, the forming unit 11 is already pivotable rearwards relatively to the working position already by a small pivoting angle φ1 and the balance point G of the forming unit is positioned merely vertically above the pivoting axis S of the pivoting bearing 23. The balance point G of the pivoting assembly 12 having the forming unit 11 as main component being pivotably supported at the frame 21 is positioned in the stable rest position according to FIG. 9 in the horizontal direction H slightly in front of the pivoting axis S. The first pivoting angle φ1 is smaller than 20°, particularly smaller than 10°. The forming station 11 can take a second intermediate state or labile balance state, as shown in FIG. 10, in which an equality of forces is present so that in an ideal case neither a pivoting forwardly in the direction of the working position nor a pivoting in the direction of the loading position backwards is executed where no external forces are acting. In this instable equilibrium position, the balance point G is positioned at or at least near the highest point of its pivoting path around the pivoting bearing 23. Starting from the working position (FIG. 1), the forming unit 11 has to be lifted against its weight force M from the working position (FIG. 1), up to the labile equilibrium state (FIG. 10). From the labile equilibrium state (FIG. 10), the forming unit 11 can be pivoted further rearwards around the pivoting axis S up to the loading position (FIG. 2). It shall be clear that the spring force F increases with increasing pivoting angle, so that the spring force F provide an ever-increasing preload force, which preloads the preforming unit 11 in the direction of the working position. Instead of the tension spring 22 or complementary to the tension spring 25, a counterweight (not depicted in detail) can be arranged in the inner cavity 22 of the frame 21 and be connected to the pivoting assembly 12 in order to provide a counterweight to the forming unit for a pivoting around the pivoting axis S. The second pivoting angle φ2 is smaller than 45° and is at about 20°.

In the first or second intermediate position, respectively, the guiding unit 17 is located at a first or a second intermediate height h1 or h2, respectively, wherein the first intermediate height h1 is lower than the working height hA and wherein the second intermediate height h2 is lower than the first intermediate height h1 and/or the working height hA.

A part of the preload force acting against the weight force M of the forming unit 11 at least in the loading position, is provided by the pivoting bearing realized as torsion spring coupling. In the loading position, the pivoting assembly 12 is pivoted from the working position to the maximal possible pivoting angle φB.

The torsion spring coupling 23 of the depicted embodiment is realized by two pressure sleeves 41 arranged pivotably fixed at the frame 21, one pressure sleeve 43 being mounted pivotably fixed at the pivoting assembly 12, one bearing brushing or bearing sleeve 41, being connected to the bearing sleeve 43 by an extending rectangular profile rod 45 and three quadruple of elastic elements or spring pads 47, respectively. The pressure sleeves 41, 43 have a quadratic inner passage contour, whose side length essentially corresponds to the diagonal width of the rectangular profile rod 45. A spring pad 47 is introduced into each of the four triangular recesses between the rectangular profile rod 44 and a respective bearing sleeve 41 or 43. Both of the frame fixed pressure sleeves 41 allow a pivoting movement of the rectangular profile rod 44 by ±30° around the pivoting axis S. A relative pivoting in the range ±30° can be employed between the rectangular profile slot 45 and the fixed bearing sleeve 43. By the series connection on the one hand of the frame fixed bearing sleeves 41, and on the other hand of the pivoting assembly fixed bearing sleeve 43, a pivoting range of about 90° is allowed.

Depending on the relative position of the bearing sleeves 41, 43 and the rectangular profile to each other, a torsional moment T is employed around the torsion spring coupling 23. Preferably, the highest possible torsional moment T in the loading position is provided and is acting there against the weight force M of the forming unit 11. The torsional moment T also slows down the lowering movement of the forming unit starting from the labile equilibrium position (FIG. 10) in the direction of the loading position. A torsional moment T can act against the weight force M of the forming unit also in a working position as well as in the first stabile intermediate position (FIG. 9), if applicable, so that a lifting of the forming unit 11 from the working position in the direction of the loading position is facilitated. The bearing 23 also receives vertical bearing forces LV and horizontal bearing forces LH.

The attributes disclosed in the preceding description, the Figures and the claims can be used for the realization of the invention in the different embodiments and both separately and in arbitrary combination.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description. While various embodiments of the invention have been described, it will be apparent to those of ordinary skill in the art that many more embodiments and implementations are possible within the scope of the invention. Accordingly, the invention is not to be restricted except in light of the attached claims and their equivalents.

List of Reference Numerals

1 provision apparatus
3 packaging material
5 paper strip
7 Leporello stack
11 forming unit
12 pivoting assembly
13 feed unit
15 preforming station
17 guiding unit
18 deflection roller
21 frame
22 inner cavity
23 pivoting bearing, torsion spring coupling
25 tension spring
27 foot
31 control panel
33 initialization switch
35 cover
41, 43 bearing sleeve
45 rectangular profile rod
47 spring pad
51 securing band
53 securing pin
55 fastener
61, 63 feed roller
65 outlet opening
a ejection direction
f paper feed direction
p feed path
$h_A$, $h_B$, $h_1$, $h_2$ height
B base
F spring force
G balance point
H horizontal direction
$L_H$, $L_V$ bearing force
M weight force
Q transverse direction
S pivoting axis
T torque
U user
V vertical direction
X front side
Y rear side
$\varphi_B$, $\varphi_1$, $\varphi_2$ pivoting angle

I claim:

1. An apparatus for the provision of packaging material, comprising:

a forming unit configured to: produce a packaging material from a Leporello paper strip stack, and eject the packaging material, wherein the forming unit further comprises:

two feed rollers opposing each other for driving the paper strip;

a motor for operating the feed rollers; and an outlet opening for the packaging material at its front side, wherein the forming unit is pivotable backwards from a working position to a loading position;

an initialization switch configured to activate the motor of the feed rollers, wherein the initialization switch is disposed on the forming unit and is accessible at its rear side in the loading position;

a preforming station being positioned upstream from the feed rollers along a paper feed direction and configured to transversely compress the paper strip;

a guiding unit positioned upstream from the preforming station in the paper feed direction and configured to align the paper strip for the preforming station; and a frame, on which the forming unit is pivotably supported between the working position and the loading position, wherein in the working position, the forming unit is aligned downwards in an ejection direction for ejecting the packaging material, the forming unit in the loading position being lower relative to the working position, wherein the motor is configured to be activated in the loading position, and wherein, in the loading position, a preload force is acting against a pivoting motion of the forming unit.

2. The apparatus according to claim 1, wherein the forming unit is configured to operate the motor during normal operation with a load of at least 60% of the full load, on activation of the motor in the loading position by the initialization switch.

3. The apparatus according to claim 1, wherein in the loading position, a manual introduction access is provided for introducing the paper strip into the feed rollers.

4. The apparatus according to claim 1, wherein the forming unit comprises a securing switch having a release state for an activation of the motor by the initialization switch, and having a securing state which prevents the activation of the motor in the loading position.

5. The apparatus according to claim 4, wherein the securing switch can adopt the release state in a closed position of a tool-free removable safety cover for covering the feed rollers, or the preforming station.

6. The apparatus according to claim 1, wherein in the working position, the forming unit is aligned downwards in the ejection direction for ejecting the packaging material, further wherein the forming unit in the loading position is lower relative to the working position, and in the loading position, the preload force is further acting against a weight force of the forming unit.

7. An apparatus for provision of packaging material, the apparatus comprising:

a forming unit configured to: produce a packaging material from a paper strip, and eject the packaging material, the forming unit comprising:

a feed unit configured to draw the paper strip;

a Leporello stack-shaped paper strip supply;

two feed rollers opposing each other and configured to drive the paper strip; and a motor configured to operate the feed rollers;

a provision being positioned upstream from the feed unit in a paper feed direction and configured to transversely compress the paper strip;

a guiding unit positioned upstream from the preforming station in a paper feed direction and configured to adjust the paper strip for the preforming station; and a frame, on which the forming unit is pivotably supported between a working position and a loading position, wherein when in the working position, the forming unit is aligned downwards in an ejection direction and configured to eject the packaging material, further wherein the forming unit in the loading position is lower relative to the working position, and when in the loading position, a preload force is acting against a weight force of the forming unit and is acting against a pivoting motion of the forming unit.

8. The apparatus according to claim 7, wherein in the working position, the preload force acts against the weight force of the forming unit.

9. The apparatus according to claim 8, wherein the forming unit is pivotably supported with a torsion spring coupling at the frame, wherein the torsion spring coupling comprises at least one elastic element with an elastic restoring force providing at least partially the preload force for the loading position and/or the working position.

10. The apparatus according to claim 9, comprising a tension spring or a movable slidably supported counter weight for the provision of at least a part of the preload force in the loading position, wherein the tension spring or the counterweight is arranged in an inner cavity of the frame.

11. The apparatus according to claim 7, wherein a guiding connection member securing band holds the forming unit in the loading position, the guiding connection member securing band being mounted to the forming unit or the frame and interacting with a securing pin fixed with the apparatus.

12. The apparatus according to claim 7, further comprising a paper strip supply that includes the Leporello stack arranged between two feet of the frame.

13. The apparatus according to claim 7, wherein when in the loading position, a preloading force causes a weight release that includes releasing at least 25% of the weight force of the forming unit.

14. The apparatus according to claim 13, wherein the preloading force acts in at least one pivoting range starting from the loading position and being larger than 10°.

* * * * *